US006269746B1

(12) United States Patent
Larsen

(10) Patent No.: US 6,269,746 B1
(45) Date of Patent: Aug. 7, 2001

(54) DISARM MECHANISM FOR EXPLOSIVE EQUIPMENT

(75) Inventor: Theodore E. Larsen, Minneapolis, MN (US)

(73) Assignee: Advanced Innovation, Inc., Bloomington, MN (US)

( * ) Notice: Subject to any disclaimer, the term of this patent is extended or adjusted under 35 U.S.C. 154(b) by 0 days.

(21) Appl. No.: 09/450,047

(22) Filed: Nov. 29, 1999

(51) Int. Cl.[7] ..... F42C 15/40

(52) U.S. Cl. ..... 102/262; 102/262; 102/221; 102/222; 102/200

(58) Field of Search ..... 102/222, 221, 102/262, 200

(56) References Cited

U.S. PATENT DOCUMENTS

| | | | | |
|---|---|---|---|---|
| 2,744,976 | * | 5/1956 | Black | 102/262 |
| 3,744,422 | * | 7/1973 | Zangrando | 102/262 |
| 3,908,553 | * | 9/1975 | Beach | 102/262 |
| 4,110,576 | * | 8/1978 | Cusick et al. | 200/82 |
| 4,815,381 | * | 3/1989 | Bullard | 102/247 |
| 5,279,226 | * | 1/1994 | Ritchie et al. | 102/254 |
| 6,112,668 | * | 9/2000 | Woodall et al. | 102/417 |
| 6,164,383 | * | 12/2000 | Thomas | 169/61 |

* cited by examiner

*Primary Examiner*—Charles T. Jordan
*Assistant Examiner*—Lulit Semunegus
(74) *Attorney, Agent, or Firm*—James R. Cwayna

(57) ABSTRACT

A disarm mechanism to maintain a safe work area for individuals that may be working in such area which allows for the remote disarming of an article of explosive equipment by remotely shifting a switch of an explosive circuit to an off or non-operative position. Said switch is connected in series with a detonator and along with an explosive charge housed within an extinguishant container from which extinguishant would normally be dispelled when the explosive circuit is activated. After switching, a lock-out device is secured to the disarm mechanism such that the switch cannot be shifted to the on or operative position without removal of such lockout. Visual indicia is provided to alert the operator as to the position of the control switch. To further insure disarm and safety within the safe area, a source of expelling pressure communicating with the extinguishant container and available for activation when the switch is in the on or active position, is prevented from communicating with the extinguishant container when said switch is shifted to the off position. The remote shifting means is electrically isolated from the switch, so that no path is created for electric charges to flow from the safe environment, in which the switch is located, to any external hazardous environment.

18 Claims, 5 Drawing Sheets

DISARM MECHANISM FOR EXPLOSIVE EQUIPMENT

SPONSORSHIP

This invention has not been made under any Federal or Independent sponsorship and is the individual result of the efforts of the Applicant.

RELATED APPLICATIONS

Applicant has not filed any previous application related to the subject matter of this application and is not aware of any applications that may be on file by other applicants that would relate to the subject matter of this application.

FIELD OF THE INVENTION

This application relates generally to the disarmament of explosive devices and more particularly to a mechanism for remotely disarming an explosive device by short-circuiting the connections to a detonator bridge and thus the detonator through a remote control to positively shift the detonator bridge control switch from an on to an off position with the capabilities of locking the same in the off or short circuit position to prevent expulsion of a suppressant material to a protected area. The application also includes structure for selectively connecting a source of pressure to the area containing the suppressant material.

SHORT SUMMARY OF THE INVENTION

A mechanism for remotely disarming an explosive device contained within a suppressant containing housing. One end of the housing is directed toward a rated or need to be protected area with the other end directed to a pressure source which will supply propelling force to the suppressant when the device is activated due to an impending explosion which is sensed by a rise in pressure in the protected area, or which could also be sensed through optical means being responsive to the characteristics of an impending explosion. The explosive device includes an intrinsically safe power supply or intrinsically safe connection to a power supply, a detonator and detonator bridge circuit with a switch between the supply and detonator and bridge, with the detonator arranged within the suppressant containing portion of the housing. Within this section a predetermined amount of extinguishing material is maintained.

Applicant's invention provides for non-mechanical control of the switch to short circuit the detonator bridge and prevent suppressant expulsion into the protected area and further includes a shiftable latching device for control of suppressant expelling air during the period when the detonator bridge and detonator is deactivated.

Applicant's equipment is designed to react to developing explosions that can occur inside of rated or process enclosures which may include combustible dusts, gases or vapors. It responds to the presence of a developing explosion after it starts and then delivers a suppression agent into the process volume to extract heat from the developing fireball, thus extinguishing the same before it grows to damaging proportions. The initial detonator explosion, resulting expulsion and propulsion of suppressant material will extract heat from and reduce the volume of a developing fireball from which an explosion forms and continued expulsion and propulsion of extinguishing material by the released air from the pressure source will extinguish the fireball and prevent damage.

The remote, non-electrical switch employs a magnetic field control to disconnect the detonator control bridge from electrical power and simultaneously short circuit the bridge. The switch is, selectively, of the reed type which is controllable by the position of a magnetic field relative thereto such that one position of the magnet will permit the contacts of the switch to maintain a closed position for power supply to the bridge and a manual rotation of the magnet toward the reed switch and aligned with the same by an external knob will open the connecteion to the power supply and simultaneously short circuit the detonator wires connected to the switch.

The lengths of wire between the power supply and the detonator bridge in the system are selected to eliminate the possibility that sufficient energy could be induced to such wires to actuate the detonator bridge.

In addition to the above, means is provided for an OSHA lockout device to be secured to the external knob, to prevent either intentional or accidental moving of the magnet and thus magnetic field from the Off position of the switch to its On position, and both local and remote signaling devices are provided to inform personnel as to condition and position of the switch.

BACKGROUND AND OBJECTS OF THE INVENTION

The Applicant has a long history of experience in the field of fire and explosion detection and control in processes involving agricultural dusts, pharmaceutical dusts, propane/air mixtures and other combinations characterized by a relatively long initial period of slow fireball growth prior to the "explosion" reaching its maximum rate of pressure increase and which are referred to as deflagrations. The equipment with which he is most familiar is not able to control the ignition (detonation) of high explosives, as, comparatively, they do not go through an initial period of relatively slow growth before reaching their maximum rate of pressure rise. The primary difference is that materials involved in a deflagration (slow initial rate of pressure rise) must seek out oxidizers contained in the air, and this process is accelerated as the fireball increases in surface area. In the case of detonation, the oxidizer is already mixed with the fuel, so the pressure rise is achieved almost instantaneously.

This invention then is directed to the control of a deflagration-type of "explosion" but this requires use of materials that will detonate to achieve suppression of a developing fireball, because the "relatively slow fireball growth rate" of the deflagration involves only milliseconds, the blink of an eye, and it has a head start on the counter measures.

The invention also considers at least one particular condition. In certain installations, it is often necessary to protect maintenance personnel that may be working in the "rated or protected" area, referred to as a hazardous area, from spurious discharge of explosion-response devices and certain, in-use, methods include mechanical blocking devices. These may cover those devices that utilize high discharge pressures in the range of 500 psig to 900 psig, where accidental discharge may create, not only a "scary" but dangerous situations, to maintenance personnel. With the Applicant's devices which utilize a low, 200 psig pressure level, an accidental discharge may be more "scary" than dangerous but this is still a concern of maintenance personnel.

It is well known in the field of explosives that detonators, including blasting caps, must have their connecting wires shorted to each other in order to prevent spurious discharge. This is necessary because wires serve as antenna which can pick up energy from various sources such as radio transmission waves or adjacent wires carrying alternating current. The result could be that sufficient energy is fed to the low resistance detonator bridge circuit that their coating of pyrotechnic material ignites, setting off the explosive train that is common to all detonators.

Applicant's invention provides a mechanism to remotely control the position of the moveable leaf of a reed switch to shift the same from an On, energy transmitting position, to an Off, short-circuiting position. Once so switched, an OSHA lockout can be coupled to prevent an accidental reestablishing of the circuit. During this period of disconnect, the invention may include a latching device to prevent release of air from a pressurized air source which could independently expel suppressant from the device.

The remote control basically consists of a rotatable magnet which is electrically and mechanically isolated from the switch, the switch and associated detonator being housed in a first housing section which contains a quantity of suppressant material which is discharged from the housing upon explosive discharge of the detonator. Such remote control magnet is mounted for rotation within a second housing section and has an external operating member such as a simple knob. To indicate to the person responsible for disarming, the knob is designed and selected to give a physically readable showing of magnet and thus switch position. Simultaneously with switch shifting, both a local, visual and a remote, visual indicator means is actuated to verify the switch position and condition to a nearby and remote location accessible to maintenance personnel and to remote locations such as a control rooms in which the fact of disarming the release device may be monitored.

When the unit is rearmed and fireball growth is sensed, the detonator discharge is initiated and the resulting explosion opens certain frangible portions of the housing to dispel suppressant with pressurized air also being simultaneously introduced to the housing to deliver the suppressant into the rated or process area.

It is therefore an object of the applicant's invention to provide a remote disarm mechanism for explosive equipment which includes structure for positively shifting the leaf of a detonator controlling reed switch into an Off, short-circuiting position without making electrical or mechanical contact with the reed switch.

It is a further object of the applicant's invention to provide a remote disarm mechanism for a detonator bridge switch which will provide a visual indication of operative condition of the detonator bridge control switch as well as a local and remote indication of such condition.

It is a further object of the applicant's invention to provide a remote disarm mechanism for a detonator bridge switch which provides accommodation for the attachment of an OSHA lockout device to a control knob thereof to prevent movement of such control knob and thus disarm mechanism.

It is still a further object of the applicant's invention to provide a remote disarm mechanism for a control switch of a detonator bridge circuit which includes the introduction and positioning of a controlling magnetic field to position such switch in an armed or disarmed position and wherein the means for controlling such field are remote from said switch or other mechanism of the explosive equipment.

It is still a further object of the applicant's invention to provide a containing latch against movement of a mechanism for release of pressurized air into the suppressant containing section of the structure, said latch being engaged simultaneously with the device that is activated with the shifting of the control switch.

It is still a further object of the applicant's invention to provide a pressure air source opening mechanism which is responsive to detonation of the explosive within the extinguishant container to open the same upon such detonation, with means to simultaneously control the same to prevent actuation of such opening mechanism when the detonation device is switched to an Off or Inactive position.

These and other objects and advantages will more fully appear from a consideration of the accompanying drawings and disclosure.

SHORT DESCRIPTION OF THE DRAWINGS

DESCRIPTION OF A PREFERRED EMBODIMENT OF THE DEVICE

Figure 1:
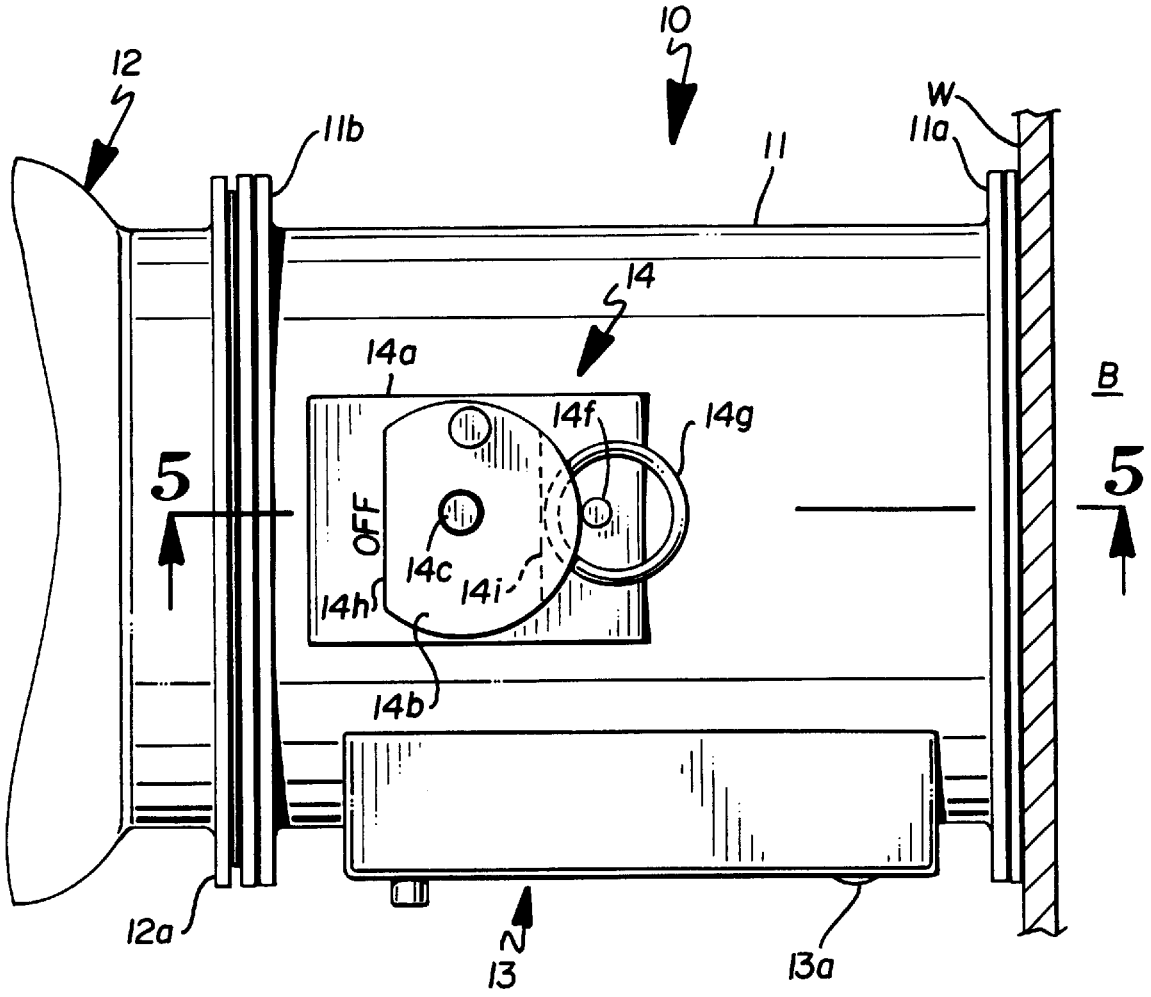
FIG. 1 is a top plan view of a device incorporating the concepts of the Applicant's invention, illustrating the same attached at one end thereof to the side wall of an area to be protected and having a pressure vessel attached to the other end.

In accordance with the accompanying drawings, the entire extinguishant propelling device embodying the concepts of the Applicant's invention is generally designated 10 and includes a longitudinally extending body member 11 attached through a flange 11*a* on one end thereof to the side wall W of a process enclosure B with a pressurized housing unit 12 secured through a flange 11*b* on the other end of the body 11. The pressurized housing unit 12 includes a flange 12*a* and appropriate fastening elements and seals are provided to secure the elements 11, 12 to each other and to the wall W. The process enclosure B may include a mixer, dust collector or similar structure. The area within the process enclosure B is protected by the device 10 and at times, such as when personnel are working within the enclosure B, the area must be maintained in a safe working condition duiring which no extinguishing materials could accidentally be released into the same.

Side wall W of enclosure B is provided with a suppressant passing opening O.

Figure 5:
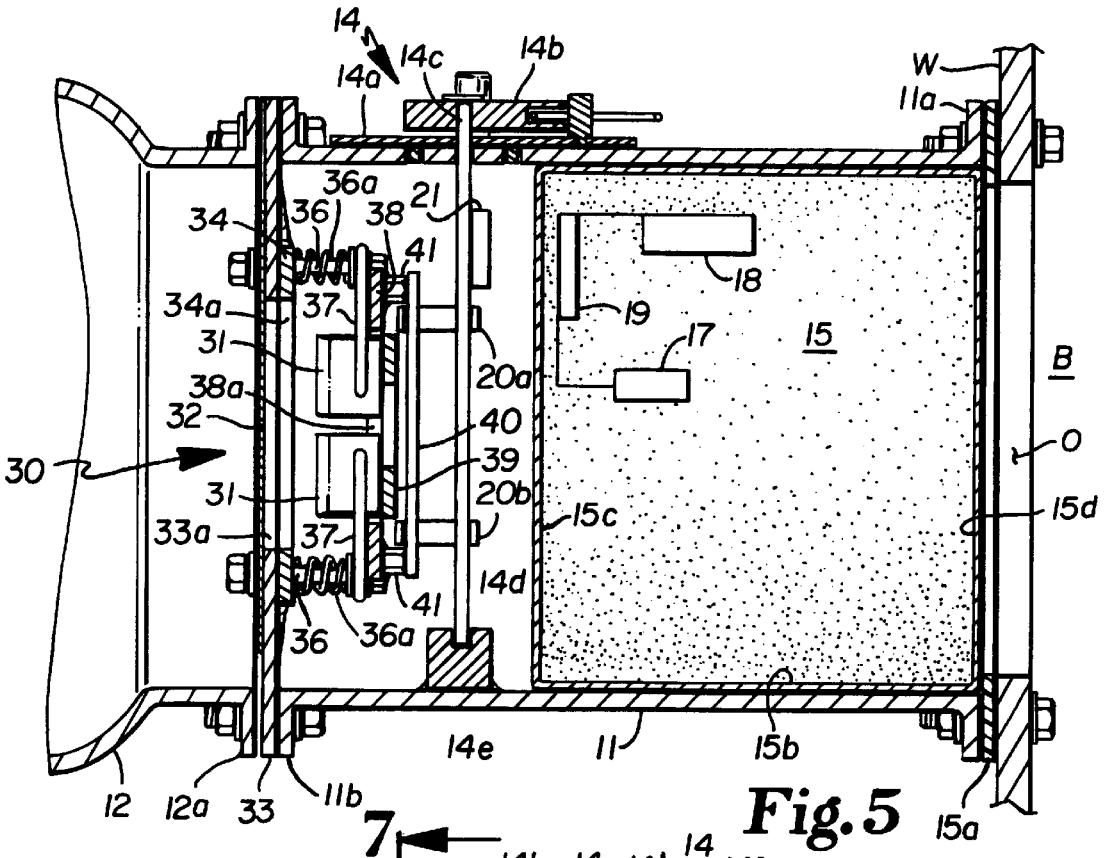
FIG. 5 is a longitudinal section taken substantially along Line 5—5 of FIG. 1 showing the internal mechanism thereof in a disarm/latching position.
Figure 6:
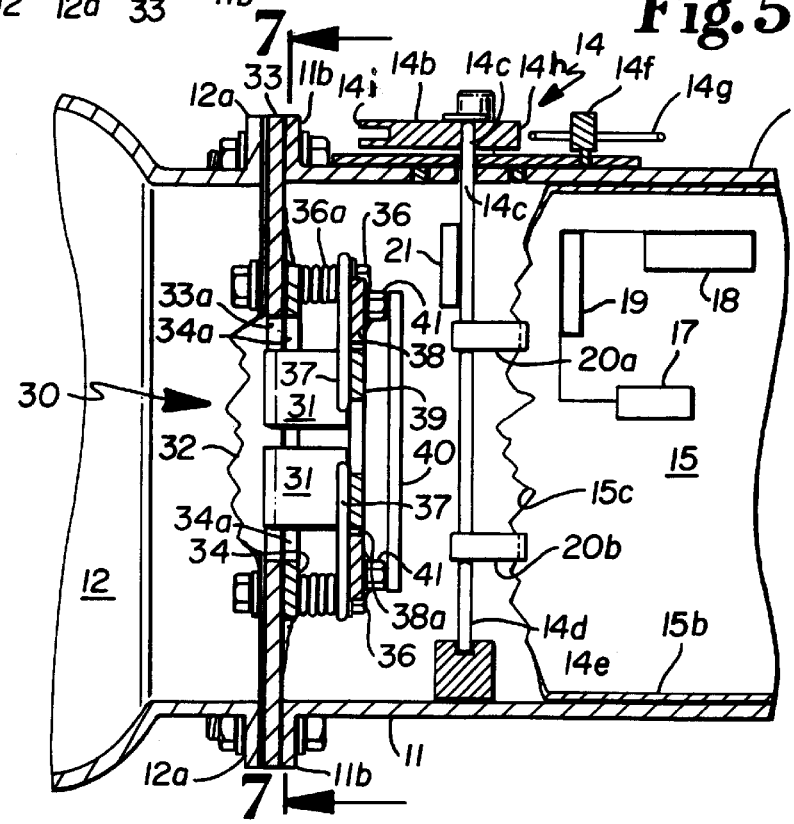
FIG. 6 is a view similar to FIG. 5 illustrating the internal mechanism thereof in extinguishing, material propelling position.
Figure 7:
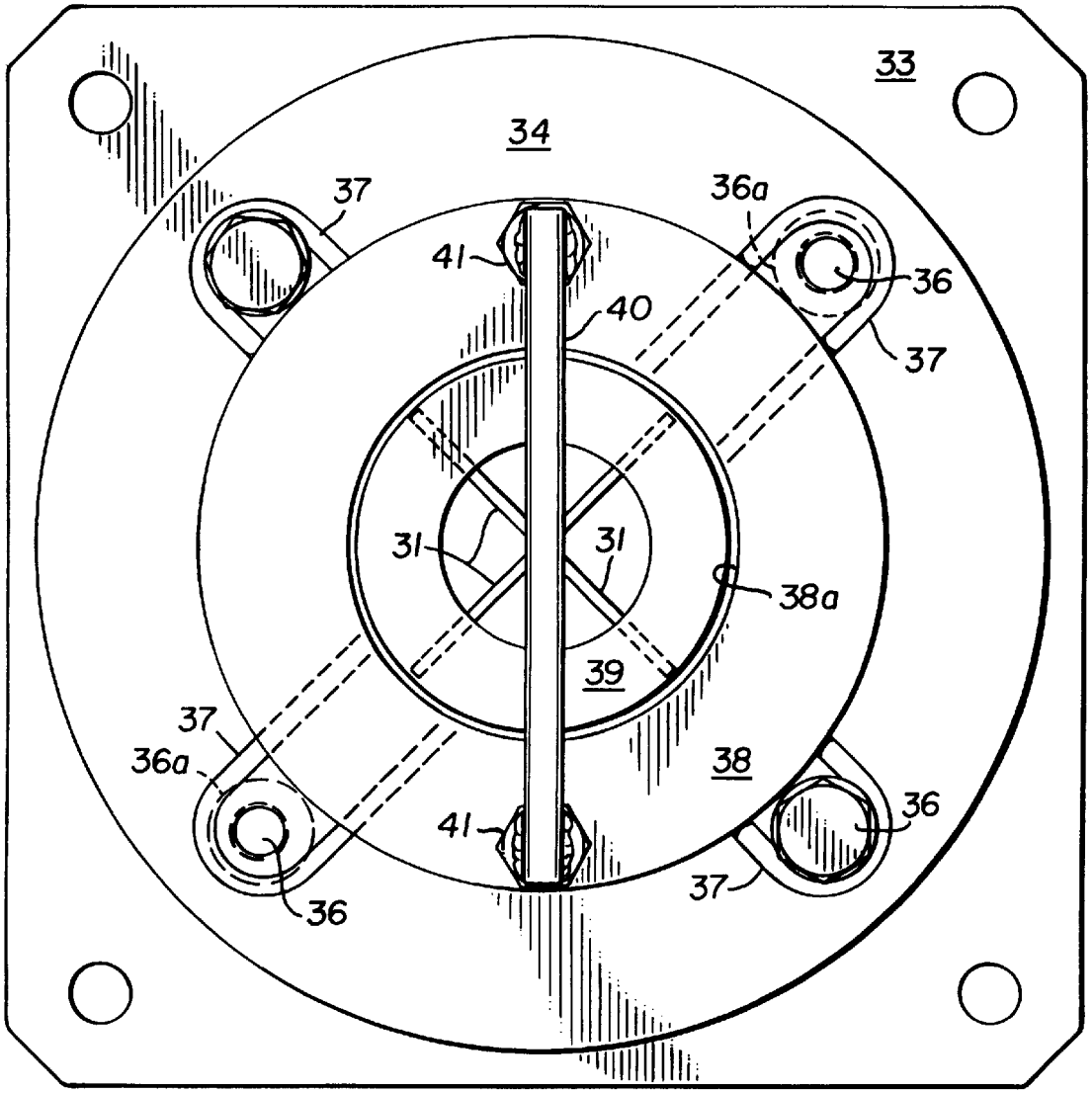
FIG. 7 is a transverse view taken substantially along Line 7—7 of FIG. 6; and, FIG. 8 is a schematic diagram of the electrical circuitry of the device.

In the particular form shown and as best illustrated in FIGS. 5 and 6, a propellant housing container 15 is received into body 11 and is provided with a locating flange 15*a* receivable between flange 11*a* of body 11 and wall W for positioning the same therein. This housing 15 consists of a longitudinally extending body 15*b* having ends 15*c*, 15*d* which will burst upon the firing of an explosive train 17 consisting of a detonator and plastic explosive mounted therein to allow expulsion of the extinguishant material into the enclosure B area. The extinguishant material is illustrated as a granular substance in FIG. 5.

Figure 2:
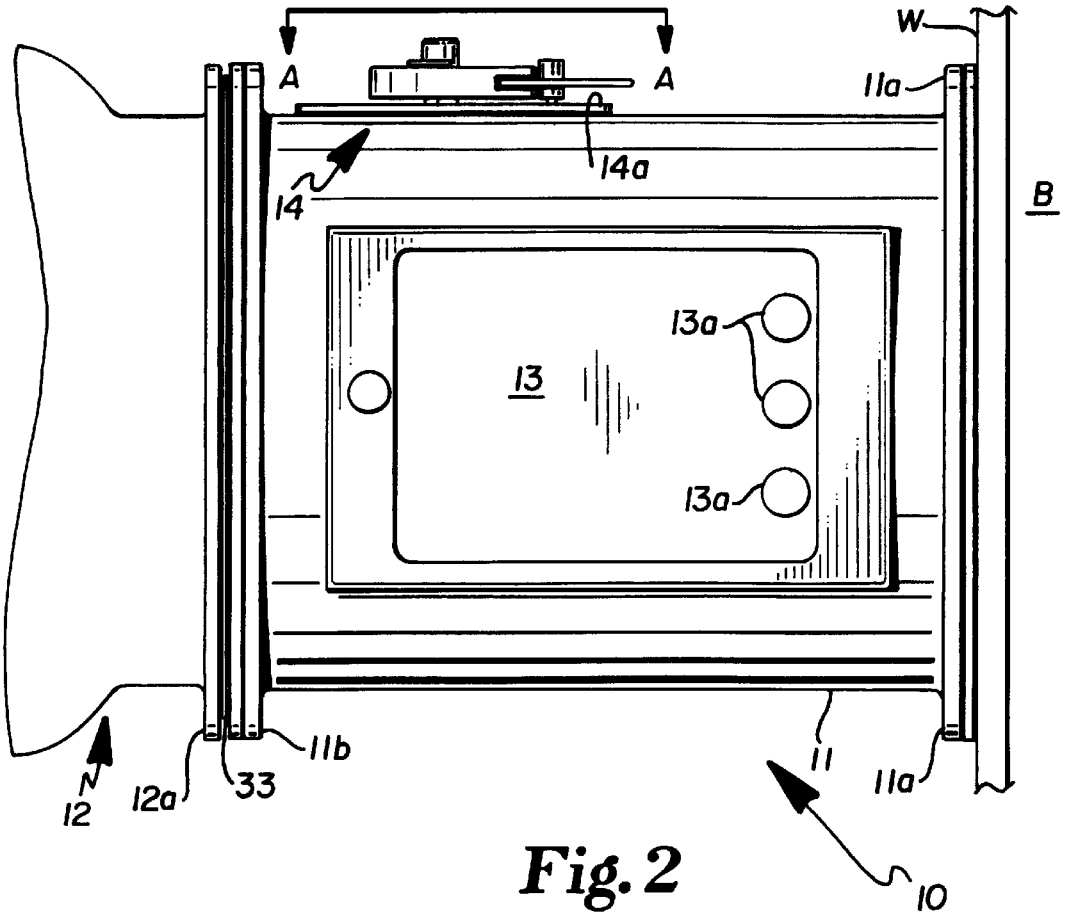
FIG. 2 is a side view of the device illustrated in FIG. 1.
Figure 3:
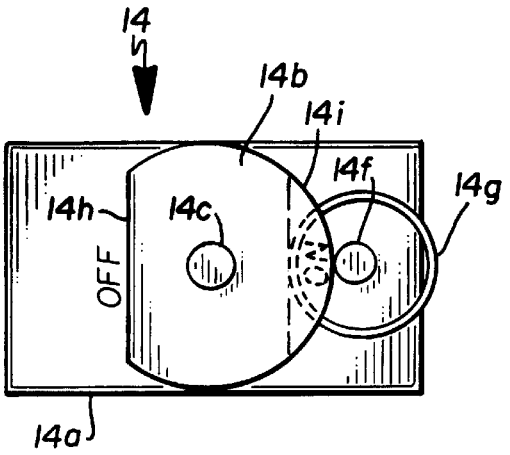
FIG. 3 is a view of a portion of the top of the device taken substantially along and limited to Line A—A of FIG. 2 illustrating a first operative position of the disarming device.
Figure 4:
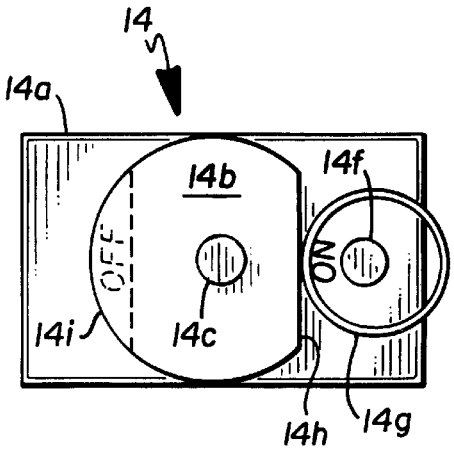
FIG. 4 is a view similar to FIG. 3 illustrating a second operative position of the disarming device.

The explosive train 17 is connected to a primary circuit including a power transfer unit 18 and a control switch 19. The power transfer unit 18 receives transmittal information from a sensor system, not shown, which senses the condition within the process enclosure B such that upon the occurrence of a developing explosion, deflagration, it will cause the explosive train 17 to activate, fragmenting the ends 15*c,* 15*d* of the housing 15 and directing the suppresant material into the process enclosure B. Such discharge sequence can proceed only if the control switch 19 is in activation condition, as will be explained. It should be noted that switch 19 is relatively close to end 15*c* of hosing 15 such that it can be magnetically coupled from outside container 15 and thereby be controlled by a remote magnetic field. This arrangement then eliminates any operativeness of the detonator 17. In order to convey this position to the operator, plate 14*a* and underlying knob 14*b* is provided with an "On", "Off" visual indication and electrical circuitry is provided to give a local and visible readout through indicator lights, all designated 13*a* in FIG. 2, and arranged on a panel inside housing 13. A window on the cover of housing 13 enables the indicator lights to be observed by an operator. The circuit will also provide audible and visible readout to a remote location, not shown. Such circuitry is relatively simple to provide and is not thought that specific circuitry to obtain these results is necessary to an understanding of the invention.

When the knob 14*b* and associated magnet 21 are in position to deactivate detonator circuit through position of the reed switch 19, a lockout arrangement is provided which includes a post 14*f* which will retain an OSHA approved lock-out 14*g* device when inserted in an internal groove 14*i* of knob 14*b*. As illustrated, knob 14*b* is specifically shaped to selectively display the markings on plate 14*a* and is provided with an external, flattened surface 14*h* and the internal groove 14*i* to receive such OSHA lockout device. This lock-out device will, when received into groove 14*i,* prevent rotation of such knob 14*b* to the activation of the detonator switch 19. It should also be noted that when the flat surface 14*h* of the knob 14*b* is positioned adjacent post 14*f,* a removable stop, not shown, could be inserted therebetween. The aspect of both the OSHA device 14*g* and such a stop would require a person to physically perform a mechanical operation in order to shift the control magnet 21 from the active to non-active position and vice-versa position for control of switch 19 and thus detonator 17.

The device to this point of description then provides a unit which provides a first degree of safety for personnel in the protected area, but some installations require an additional level of safety correlation. When detonator 17 has been fired, the frangible ends 15*c,* 15*d* of housing 15 are essentially blown out with the first such side 15*c* opening communication to the pressurized air source 12 and the other side 15*d* expelling extinguishing material to the process enclosure B.

To provide the added personal safety feature and provide against possible extinguishing material being delivered to the protected area B, applicant provides a positive lock-out to the pressurized source. Normally, upon detonator 17 actuation, the explosive power will drive knife elements 31 attached to a movable plate, generally designated 39 through a frangible seal 32 between cannon 11 and pressurized housing 12 such that air therefrom will force its way through the cannon body 11 to expel and insure expulsion of extinguishing material therefrom into the protected area. This additional force will also insure that such material is propelled a sufficient distance, for example, more that one-half the width or dimension of the protected area B. It should be understood that several cannons and several of Applicant's devices will be deployed about the protected ara and this expulsion will insure total coverage of the protected area.

In the form shown, the knife assembly 39 is attached to a primary mounting plate 33 secured between flanges 11*a* of cannon 11 and flange 12*a* of pressurized tank 12. This plate 33 is provided with a central opening 33*a* therethrough. Knife assembly 39 includes a first mounting plate 34 with a central passage 34*a* secured to primary plate 33 and is provided with a plurality of stationary standoffs 36, each of which is provided with a surrounding spring member 366*a*. Attachment ears 37 are provided for movement of the knife assembly 39 on said standoffs 36 and are secured to a centrally apertured plate 38, the aperture being designated 38*a*. Plate 38 then is movable upon the springs 36*a* but is normally biased upwardly therefrom if no force is applied thereto as would occur upon detonation within cannon 11.

Arranged for sliding movement with respect to apertured plate 38 is a central, knife carrying plate 39 to which knives 31 are attached and to which a cross control bar 40 is secured to by welding to plate 38. The principal of such mounting being that plate 38 may be moved by physical force on the surface 15*d* of cannon 11 but knives 31 will not penetrate through seal 32 unless they are free to move. Cross control bar 40 then is positioned on plate 39 such that hook ends of hook elements 20*a,* 20*b* will grasp the same and prevent movement of such plate 39 and thus knives 31 when the knob is positioned so that magnet 21 magnetically engages switch 19 to deactivate the same. Expulsion of extinguishing material from canister 15 through force exerted on end 15*d* of canister 15 could not force knives 31 through tank seal 32 because plate 39 is restrained by hook arms 20*a,* 20*b* and therefore cannot penetrate seal 32.

When the position of hooked arms 20*a,* 20*b* and magnet 21 and the detonator switch is in active position, detonation will result in end 15*a* of housing opening, the explosive force moving the knife carrying plates 38 and 39 now moving together into seal breaking position to fragment seal 32 and allow air passage through the cannon 11.

With Applicant's concept, a dual safety arrangement is provided which makes the protected area truly safe for personnel that may be working in the same.

Figure 8:
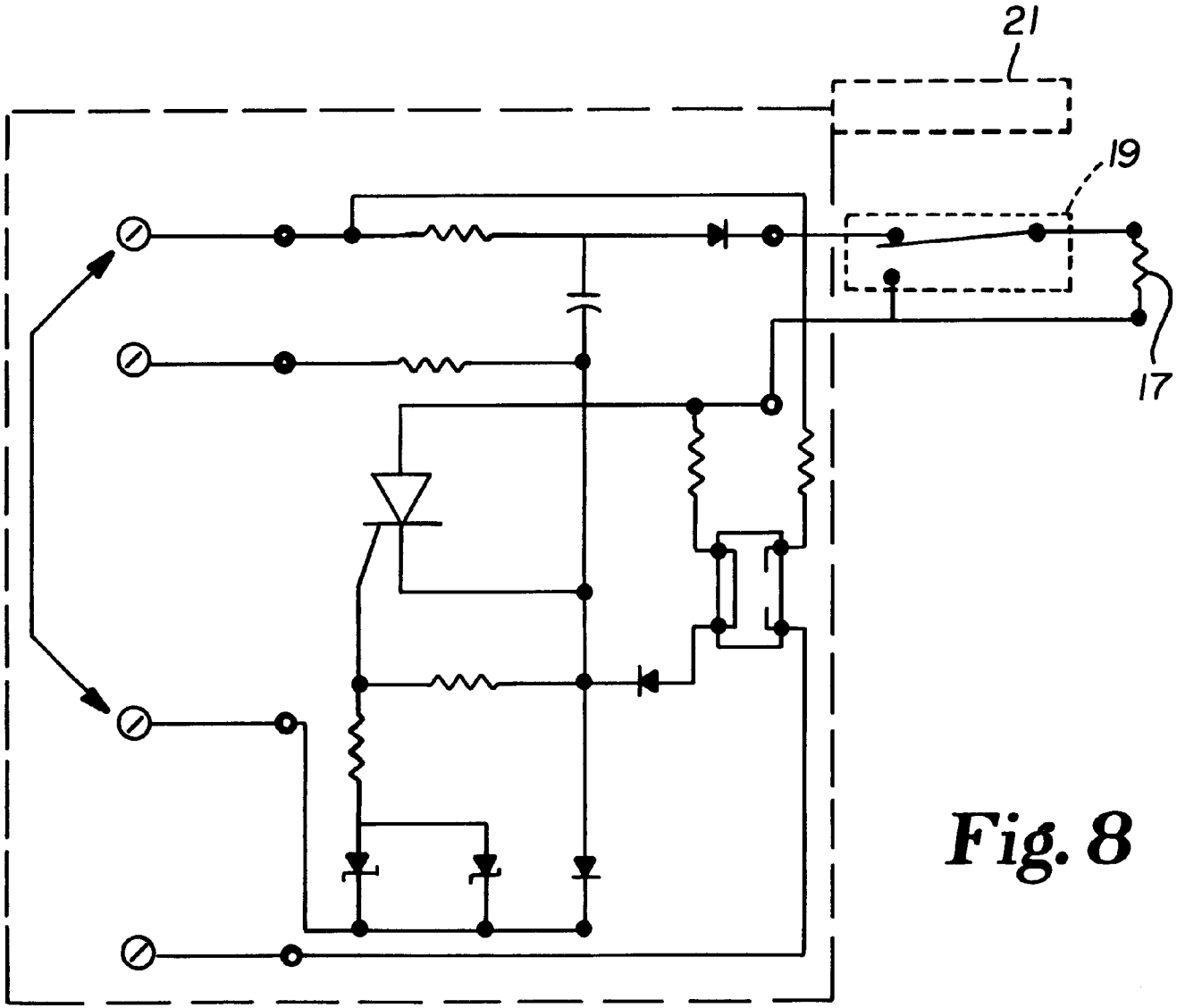

The circuitry of the system is schematically illustrated in FIG. 8 as the important portions thereof relate to magnet 21 controlling the reed switch controlling the detonator bridge and detonator 17. The remainder of the circuit is and has been established as intrinsically safe and normally is without the cannon body 11.

As illustrated in FIG. 8, when the reed switch 19 has been shiftted by the position of magnet 21, the switch element thereof provides a short circuit to the detonator bridge and thus detonator 17.

Applicant's unit then provides this dual safety concept with a single manipulative control not requiring multiple actions by the operator and, as stated, both local and remote indications of active and inactive conditions are simple extentions from the unit described and illustrated.

What is claimed is:

1. A detonator disarming mechanism including:

a) a housing;

b) at least a detonator and a switch being connected to one another within said housing;

c) a source of power connected to said switch;

d) means for shifting said switch from a detonator active to a detonator inactive position;

e) said switch shifting means being arranged exteriorly of said housing;

f) said switch shifting means having only non-electrical connection to said detonator and said switch;

g) said switch having a magnetically attractive moveable element; and, h) said switch shifting means includes a magnetic means shiftable to provide magnetic attraction to said moveable element of said switch to shift the same to detonator inactive position.

2. The detonator mechanism as set forth in claim 1 wherein;

i. said switch includes a reed switch having a magnetically attractive moveable element; and, j. said switch shifting means includes a magnetic means shiftable to provide magnetic attraction to said moveable element of said reed switch to shift the same to detonator inactive position.

3. The detonator disarm mechanism as set forth in claim 2 and said moveable element of said reed switch being normally biased to maintain the same in detonator active position.

4. The detonator disarm mechanism as set forth in claim 1 wherein said detonator inactive position includes a detonator short circuiting position.

5. The detonator disarm mechanism as set forth in claim 2 and position indicating means associated with said switch shifting means to provide a visual readout of the position of said switch shifting means and its association to said reed switch moveable element.

6. The detonator disarm mechanism as set forth in claim 2 and positioning indicating means associated with said switch shifting means to provide a light visible indication of the position of said switch shifting mean and said reed switch moveable element, such visible indication being closely associated with said switch shifting means.

7. The detonator disarm mechanism as set forth in claim 1 and, g) position indicating means associated with said switch shifting means to provide a signal;

h) a signal receiving means arranged in a location remote to said switch shifting means; and, i) means in a remote location receiving said signal and converting the same to, selective, audio and video outputs.

8. The detonator disarming mechanism as set forth in claim 1 wherein said housing includes:

g) at least frangible ends opening upon detonation of said detonator; and, h) capable of holding a predetermined amount to extinguishant material.

9. A detonator disarming mechanism in combination with a primary housing having one end thereof connected to and opening into an area to be protected with the other end thereof connected to a source of pressurized gas, said detonator disarming mechanism including:

a) a second housing with the primary housing having at least one frangible end directed towards the area to be protected;

b) at least a detonator and a switch being connected to one another within said second housing;

c) a quantity of extinguishant material within said second housing;

d) a source of power connected to said switch and arranged for power transmission to said switch upon sensing of explosive conditions in the area to be protected whereby said detonator is energized and extinguish material is dispersed from said second housing into the protected area;

e) switch shifting means for shifting said switch from a detonator active to a detonator inactive position; and, f) said switch shifting means being arranged exteriorly of said secondary housing and remotely communicating with said switch for shifting thereof through non-electrical means.

10. The detonator disarm device as set forth in claim 9 wherein;

g) said switch includes a reed switch having magnetically responsive arms; and, h) said switch shifting means including a moveable magnet positioned to control the arms of said switch.

11. The detonator disarm device as set forth in claim 10 and a switch control member associated with said moveable magnet arranged exteriorly of said primary housing.

12. The detonator disarm device as set forth in claim 11 and visible position indicator means associated with said switch control member.

13. The detonator disarm device as set forth in claim 12 and lock means associated with said switch control member for positively positioning the same in a selected position.

14. The detonator disarm device as set forth in claim 13 and light responsive indicator means associated with said control member for actuation thereof to indicate the operative position of said switch control member and said switch.

15. The detonator disarm device as set forth in claim 11 and remote indicator mechanisms associated with said switch control member for indicating the position of the same and switch control member at a remote location.

16. The detonator mechanism disarm device as set forth in claim 15 and said remote indicator including both visual and audible signaling means.

17. The detonator disarm mechanism as set forth in claim 9 and, a) a rupturable membrane arranged between said second housing and said pressurized gas source;

b) said second housing including two frangible ends, both rupturable when said detonator is activated; and, c) said rupturable member arranged between said second housing and said pressurized gas source rupturing upon activation of said detonator.

18. The detonator disarming mechanism as set forth in claim 17 and means associated with said switch shifting means preventing rupture of said rupturable member between said second housing and said pressurized gas source when said switch and controlled detonator is deactivated.

* * * * *